US006219426B1

(12) United States Patent
Daniels et al.

(10) Patent No.: US 6,219,426 B1
(45) **Date of Patent: *Apr. 17, 2001**

(54) CENTER POINT STEREO FIELD EXPANDER FOR AMPLIFIED MUSICAL INSTRUMENTS

(76) Inventors: Drew Daniels, 8831 Collette Ave., North Hills, CA (US) 91343-4825; Richard Aspen Pittman, 13994 Simshaw Ave., Sylmar, CA (US) 91342

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/821,820

(22) Filed: Mar. 21, 1997

Related U.S. Application Data

(60) Provisional application No. 60/023,719, filed on Aug. 8, 1996.

(51) Int. Cl.[7] ..... H04R 5/02

(52) U.S. Cl. ..... 381/307; 381/17

(58) Field of Search ..... 381/24, 90, 89, 381/332, 300, 303, 304, 307, 1, 17

(56) References Cited

U.S. PATENT DOCUMENTS 3,637,938 * 1/1972 Kuhlow et al. ..... 381/24
4,528,691 * 7/1985 Edwards ..... 381/89
4,819,269 * 4/1989 Klayman ..... 381/24
5,073,945 * 12/1991 Kageyama et al. ..... 381/89
5,109,416 * 4/1992 Croft ..... 381/24
5,251,260 * 10/1993 Gates ..... 381/27
5,691,493 * 11/1997 Usami et al. ..... 84/602

* cited by examiner

*Primary Examiner*—Vivian Chang
(74) *Attorney, Agent, or Firm*—J. E. McTaggart; G. F. Rothwell

(57) ABSTRACT

The CPS (center point stereo) system of the present invention is directed to stereo sound reinforcement of live music, particularly with electronically-implemented instruments such as guitars and keyboards that provide a musical source signal at line level. A special CPS processor, converting regular left and right stereo signals to sum and difference signals, enables a center stage acoustic image to be created directly from a forward-directed loudspeaker unit driven from the sum signal and enables left and right spatialized stereo images to be created by recombination with a difference field received indirectly from a sideways-directed special dipole loudspeaker unit conveniently co-located with the forward-directed loudspeaker unit and driven from the difference signal. The CPS processor receives L and R input from the instrument or from an interposed FX (musical effects) or DSP (digital sound process) unit receiving mono or stereo input from the instrument. CPS market potential ranges from full CPS systems to unique add-on CPS processors and dipole loudspeaker units as system building blocks.

13 Claims, 10 Drawing Sheets

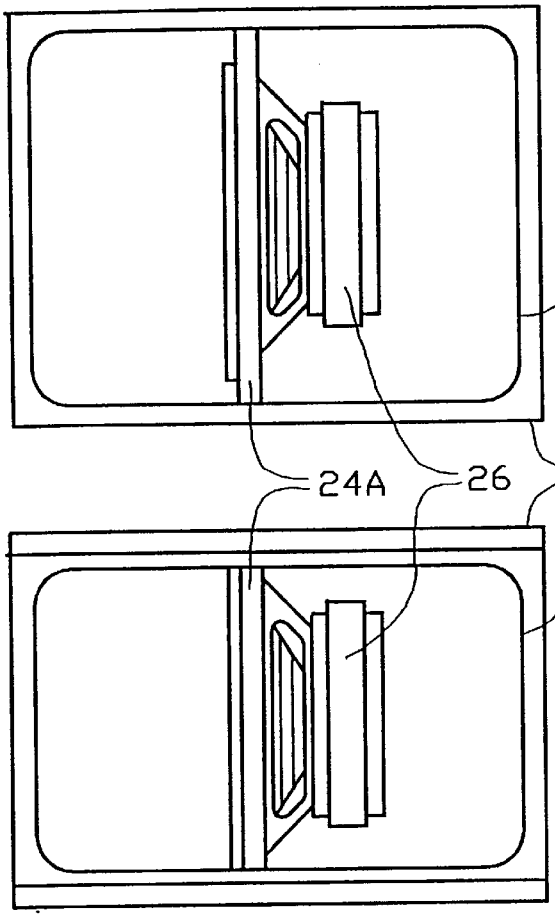
FIG. 9B
FIG. 9
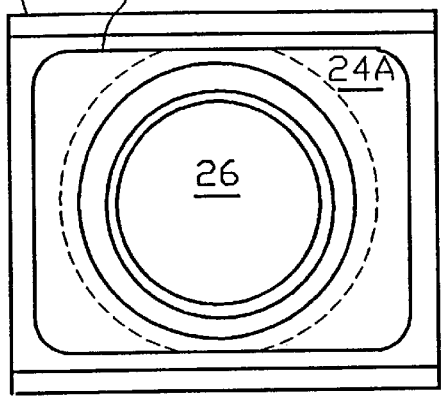
FIG. 9A
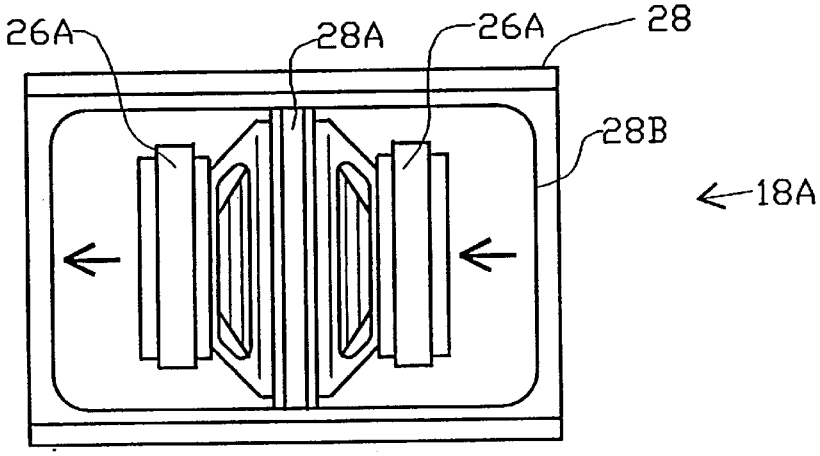
FIG. 10

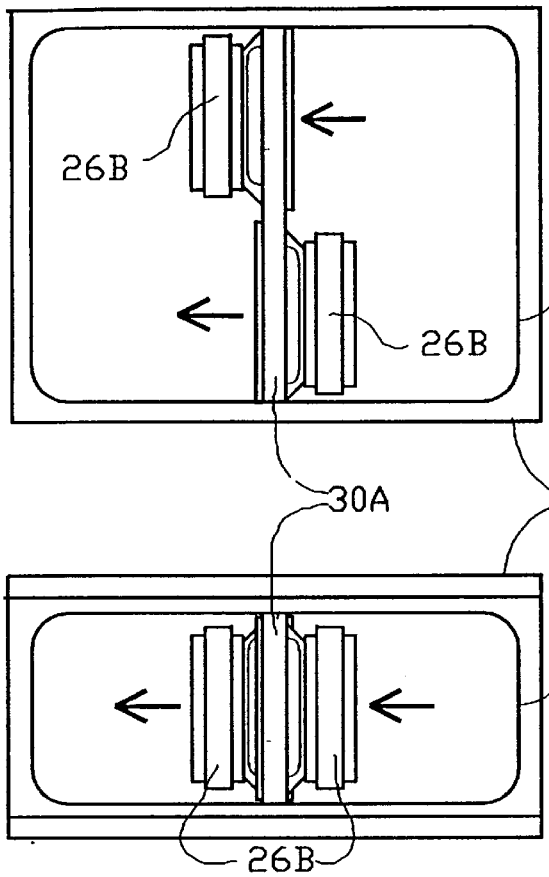
FIG. 11B
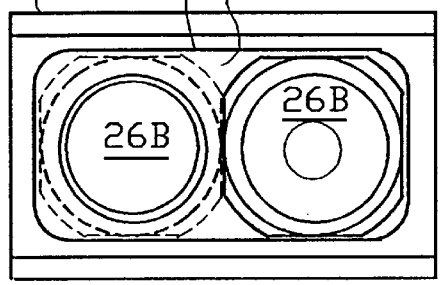
FIG. 11
FIG. 11A
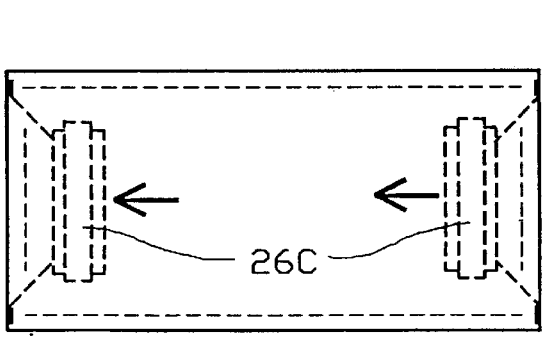
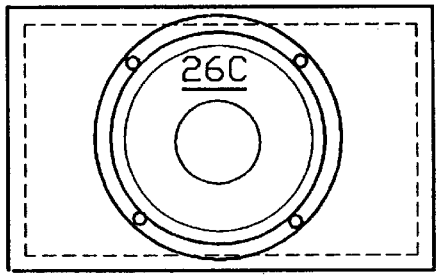
FIG. 12
FIG. 12A

CENTER POINT STEREO FIELD EXPANDER FOR AMPLIFIED MUSICAL INSTRUMENTS

PRIORITY

Benefit is claimed under 35 U.S.C, § 119(e) of pending U.S. provisional application # 60/023,719 filed Aug. 8, 1996 by the present inventors.

FIELD OF THE INVENTION

The present invention relates to the field of electronic musical instruments, and more particularly it relates to equipment for producing stereo sound effects from a centrally located speaker system, with particular benefit to live performances of electronic keyboard and guitar players.

BACKGROUND OF THE INVENTION

Although stereo sound has become universally accepted for sound reproduction, the exploitation of stereo effects in the field of amplified live music performance by solo performers and small groups has fallen short of its potential, even though many such performers are using instruments that provide capability of generating stereo output signals that could potentially enhance the overall effect of the musical performance.

The conventional practice for indoor stereo musical performance involves typically locating two spatially separated loudspeaker units at or near opposite ends of the stage or corners of the room, and driving each speaker with a dedicated amplifier, i.e. right and left channels. The physical separation between the two loudspeaker units is critical, depending on environmental factors such as the size and shape of the listening room, audience location, etc.

Excessive physical separation destroys the imaging performance, i.e. the "focus" of the point of origin of a sound image as perceived by a listener, e.g. an announcer, soloist or vocalist located at center stage where it most difficult for the two offset loudspeaker units to "synthesize" a focussed central image.

On the other hand, insufficient physical separation, while benefitting center imaging, degrades spatialization, i.e. the ability to create a full-width panoramic "sound stage" as perceived by the listener.

In practice, the limited physical separation selected as "optimal" is necessarily a tradeoff in which both imaging and spatialization are sacrificed. This "optimal" separation can perform acceptably for listeners located centrally, relative to the loudspeaker units. However, in most room or auditorium situations, some listeners will find themselves located too close to one of the loudspeaker units such that one channel will predominate: not only can the stereo effect be lost but in many cases the overall musical perception could even be judged as inferior to a monophonic performance of the same music. In the case where the musician is seeking to produce a highly spatialized stereo effect, a discriminating listener at an unbalanced listening location could perceive the performance as distracting or even totally unacceptable. The unbalance is also distracting to the musician if he is located too close to one of the stereo loudspeaker units.

If the musician or the sound technician attempts to mitigate this problem by placing the two speaker units closer together, or by utilizing a commercially available "combo-amp" unit having built-in forward-directed stereo speakers side by side built into a common case with the amplifier and thus having very little physical separation, this will tend to sacrifice the desired impact of the stereo effect, which could even become completely lost to all of the audience if the speakers are located so close together as to become practically monophonic.

While many keyboard and guitar players may develop special stereo effects in rehearsal and take great pains with these in recording, when it comes to live performance, in order to avoid ambivalence or controversy regarding stereo loudspeaker location, players may be reluctant to pursue excellent stereo performance and settle for an essentially monophonic loudspeaker setup such as a compact cluster or stack of speaker box units or the minimally separated "stereo" speakers of the "combo-amp". While this may result in a perception of more uniform coverage throughout the audience, there is a great sacrifice of the potential enhancement that effective stereo effects could add to their live performance.

In basic stereo recording modes, an orchestra can be recorded with a pair of identical microphones located at strategic symmetrical locations, e.g. at opposite sides of the orchestra stage facing inwardly to center or located centrally facing outwardly to opposite sides, and in the basic stereophonic system the two resulting independent signals L and R are customarily handled by a pair of independent channels throughout, including re-recording and playback in various media, broadcast, and all forms of reproduction equipment including power amplifiers and speakers. This basic L and R stereo system is in widespread common use as the standard system in home entertainment systems. Pure L and R signals may be subjected to some degree of cross-coupling alteration in master-recording and also in spatial-enhancement compensation circuity in small radios and stereo players having closely spaced built-in stereo speakers.

An alternative stereo recording technique known as "point source stereo" utilizes two different microphones centrally located close together, typically at front and center of the orchestra: one microphone is omnidirectional and the other is bidirectional (a.k.a. "figure 8" or "dipole") in directivity. The signals from the two microphones, being sum (L+R) and difference ±(L−R) respectively, can be handled in two audio channels, but they would normally be processed in a matrixing circuit to produce L and R stereo signals for conventional handling through L and R channels.

Though not currently in high volume usage, sum-difference loudspeaker systems have been proposed for home stereo entertainment centers, utilizing a front-firing speaker and a dual-side-firing dipole speaker, driven respectively by sum and difference signals derived by matrixing from standard L and R stereo signals.

DISCUSSION OF RELATED KNOWN ART

U.S. Pat. No. 3,588,355 to Helm discloses a stereophonic system with loudspeakers oriented at right angles to each other and receiving matrixed sum and difference stereo signals.

U.S. Pat. No. 4,819,269 to Klayman discloses an extended imaging split mode loudspeaker system receiving sum and difference signals.

U.S. Pat. No. 5,109,416 to Croft discloses a side-firing dipole speaker, receiving a difference signal, to be used in conjunction with conventional direct-path speakers, for producing ambiance sound in multichannel sound reproduction.

OBJECTS OF THE INVENTION

It is a primary object of the present invention to provide, particularly for live musical performance on electronicallyamplified instruments such keyboards and electric guitars, an electro-acoustic CPS (center point stereo) system that will process the musical source signal from the instrument's line level output and transduce it acoustically in a manner to create stereophonic sound images emanating from two loudspeaker units co-located at the center point of the CPS system, for embellishing live music performances with stereo effects.

It is a further object to disclose detailed circuitry of a CPS processor which includes an optional subwoofer line level output, for practicing the invention.

It is a further object to disclose several practical implementations of a dipole loudspeaker unit for practicing the invention.

It is a further object of the invention to provide the above described features of the primary object in a minimal electro-acoustic accessory package that will enable practice of the invention with maximal utilization of commercial electronic equipment that may be already available to a musician.

It is a still further object of the invention to disclose a total electro-acoustic embodiment including a sound processor, amplifiers and two-unit loudspeaker system that will operate from an instrument's line level output to create stereo sound images for embellishing live musical performances.

It is a still further object of the invention to disclose the further incorporation of additional stereo effects capabilities, e.g. FX and DSP, for which hardware may be available commercially.

It is a still further object to disclose a rack-mounted custom package unit containing CPS processing, special effects such as FX (musical effects, typically analog) or DSP (digital signal processing), amplification and loudspeaker units, providing the total CPS system with its sound radiators in a single stack.

It is a still further object to disclose several alternative practical CPS systems for practicing the invention.

SUMMARY OF THE INVENTION

In a basic package, the electro-acoustic element of the system according to the invention comprises, in addition to a forward-facing loudspeaker unit which may be an existing conventional unit having one or more speakers connected to vibrate in unison, a dipole loudspeaker unit having one or more speakers mounted vertically, connected to vibrate in unison and oriented to radiate transversely relative to the forward-facing loudspeaker unit, so as to radiate an acoustic field having a figure 8 dipole pattern: a pair of sideways lobes directed to opposite sides in opposite polarity.

The package also includes a CPS (center point stereo) processor of the present invention having L and R stereo audio line inputs for connection to stereo line outputs of the player's instrument and having a pair of line outputs providing (1) a "sum" signal input to a first power amplifier driving the forward-directed loudspeaker unit to radiate a "sum" acoustic field, and (2) a "difference" signal input to a second power amplifier driving the dipole loudspeaker unit, which radiates the "difference" acoustic field with the above-described dipole pattern.

The package embodiment may be expanded to include, ahead of the CPS processor, a commercial stereo FX or DSP unit that generates stereo line outputs: typically these are designed to operate from either mono or stereo line input from the musical instrument.

Other package embodiments can include one or both power amplifiers, woofer speaker units and associated power amplifiers, preamplifiers and accessories.

BRIEF DESCRIPTION OF THE DRAWINGS

The above and further objects, features and advantages of the present invention will be more fully understood from the following description taken with the accompanying drawings in which:

FIGS. 9, 9A and 9B are three views of a first implementation of a dipole loudspeaker unit with which the present invention can be practiced, utilizing a single speaker mounted on a central baffle board.

FIG. 10 is a front elevational view of a second implementation of a dipole loudspeaker unit with which the present invention can be practiced, utilizing a pair of speakers mounted face-to-face on a central baffle board.

FIGS. 11, 11A and 11B are three views of a third implementation of a dipole loudspeaker unit with which the present invention can be practiced, utilizing a pair of speakers mounted side-by-side on a central baffle board.

FIGS. 12 and 12A are two views of a fourth implementation of a dipole loudspeaker unit with which the present invention can be practiced, utilizing a pair of speakers mounted on opposite side panels of an enclosure.

DETAILED DESCRIPTION

Figure 1:
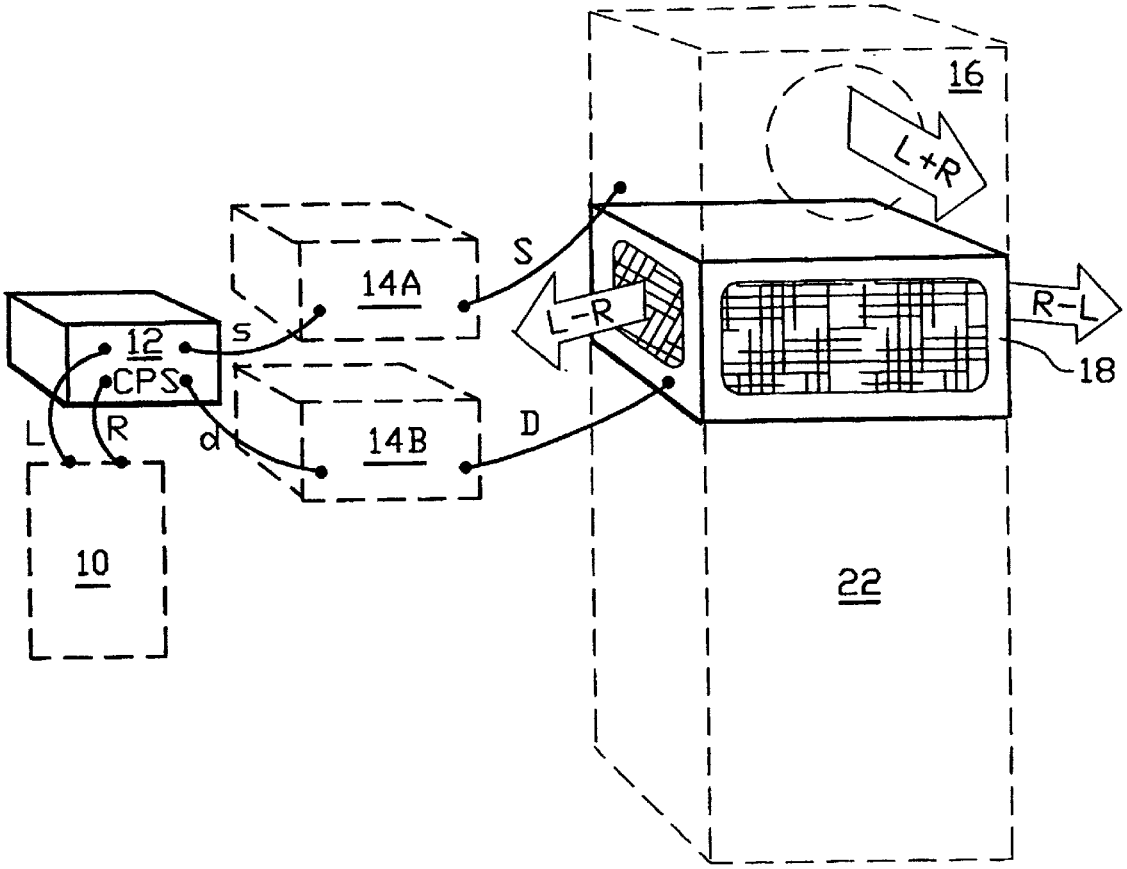
FIG. 1 is a pictorial diagram of an illustrative basic embodiment for practice of a CPS (center point stereo) system of the present invention in a typical musical performance environment.

FIG. 1 illustrates pictorially a preferred standard embodiment of the present invention. A musical signal source 10, providing stereo L and R signals as indicated at audio line outputs, represents practically any conventional musical instrument such as an "electric" guitar having one or more string pickups, a "miked" acoustic guitar or piano, a guitar- or keyboard-controlled synthesizer or tone generator, typically already owned and operated by the musician/user. Such instruments commonly provide stereo output signals L and R, which are normally directed in two independent channels leading to left and right loudspeakers through stereo amplifiers.

Designations L and R refer primarily to the perception of physical relationship in the final sound reproduction. With regard to musical source signals, while L and R may sometimes correspond to locations of different instruments and/or performers, in most instances, including the present text, L and R do not necessarily relate to any left/right relationship at the source since the two channels are often created synthetically and/or designated arbitrarily.

In FIG. 1, the L and R signals are delivered to the input of CPS (center point stereo) processor 16, wherein the L and R stereo signals are matrixed in a manner to provide a first line output sum signal s=L+R, i.e. the sum of the two input signals, and to provide a second line output difference signal d=L−R, i.e. the difference between the two input signals.

The sum signal s is amplified by power amplifier 14A which generates an amplified sum signal S that drives a conventional forward-directed loudspeaker unit 16, from which an L+R acoustic field emanates in a generally forward direction as indicated by the outlined arrow.

Similarly the difference signal d is amplified by power amplifier 14B and the amplified difference signal D is applied to the dipole speaker unit 18, which radiates acoustic signals from both sides as indicated: R−L on one side and L−R on the other side, thus emanating in mutually opposite phase relation to each other.

The difference acoustic fields L−R and R−L from the dipole loudspeaker unit 18 reach the listeners mainly via room or other environmental reflections, while the sum acoustic field R+L from the forward-directed loudspeaker 16 reaches the listeners mainly in a direct path: these two fields add algebraically at the listener's ear, thus creating a perception of the intended L and R relationship.

The gain of sum amplifier 14A can be set to provide a desired basic level of loudness, then the gain of difference amplifier 14B can be adjusted to provide a desired degree of stereo effect, ranging from monophonic through a condition of normal stereo separation as found at source 10, to a condition of exaggerated stereo separation. Such adjustment is typically performed in a manner to seek optimal compensation for the influence of room or auditorium acoustics.

The dipole loudspeaker 18 and CPS processor 12, being the non-conventional components shown in FIG. 1 in solid lines, can be marketed as a basic add-on package for musicians who already possess the conventional components shown in dashed lines: source 10, amplifiers 14A and 14B, and forward-directed loudspeaker system 16.

Speaker 18 is shown supported by a rectangular box 22 which could be merely a speaker stand to raise the loudspeaker units to a suitable listening height, or it could be a woofer loudspeaker unit for handling bass musical content in essentially a monophonic manner apart from the stereo midrange content.

Whereas a conventional stereo system for musical instruments requires physically separated L and R speakers, the present dipole speaker system, utilizing mainly reflected paths for the side-directed difference signals, produces the perception of stereo sound to listeners in the room or auditorium, with all of the loudspeakers in the player's system located close together, typically in a central stack and even combined in a common enclosure, providing wide coverage over most or all parts of the room or auditorium, which plays an acoustically interactive role in creating the perception of the stereo musical effect.

For a keyboard or guitar player, the capability of stereo performance as enabled by the CPS system with all the loudspeaker units stacked at one location is clearly an advantage in dealing with sound stage setup scenarios for live performances. With the further potential enhancement of a more uniform audience coverage from CPS, the player is motivated to more fully exploit the live performance potential of the stereo capabilities already existing in his/her electronic instrument or easily added thereto.

Figure 2:
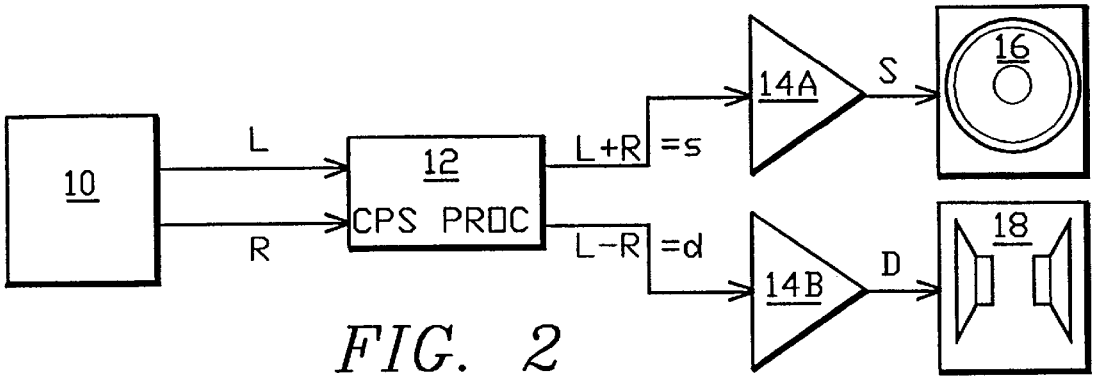
FIG. 2 is a functional block diagram of the subject matter of FIG. 1.

FIG. 2 is a functional block diagram of the preferred embodiment illustrated pictorially in FIG. 1.

FIGS. 3–7 are functional block diagrams of CPS systems of the present invention in different embodiments having, in common with FIGS. 1 and 2, a pair of amplifiers 14A and 14B receiving as input respectively a sum signal s and a difference signal d which are delivered as amplified replicas S and D respectively to a forward-directed sum loudspeaker unit 16 and a sideways-directed dipole loudspeaker unit 18.

Figure 3A:
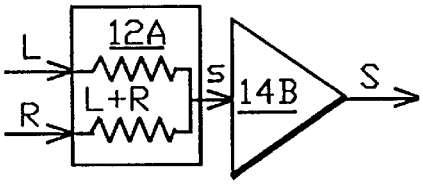
FIGS. 3–7 are functional block diagrams of alternative embodiments in which CPS of the present invention may be practiced, derived from the basic-embodiment of FIGS. 1–2.
Figure 3:
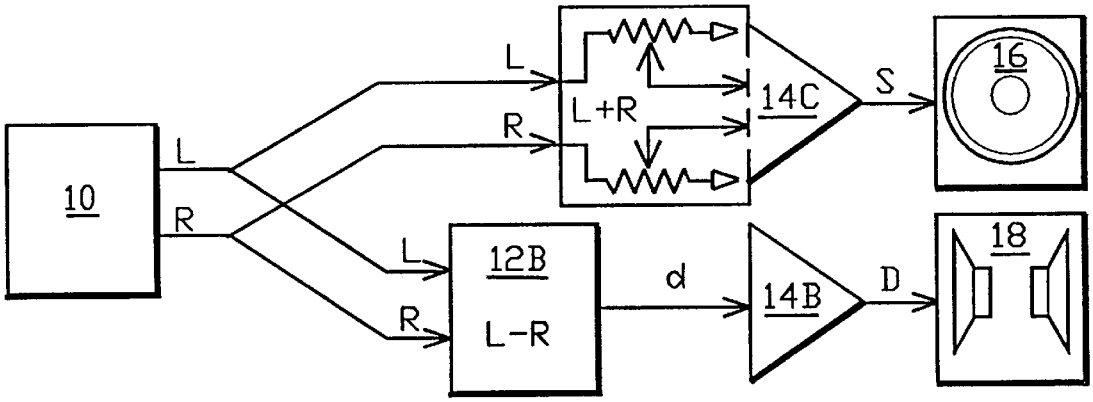

FIG. 3 is a version that is functionally equivalent to FIG. 2 but with the summing and subtracting portions of the CPS processing performed separately rather than both in a CPS processor module. When a power amplifier is available equipped with dual gain-controlled inputs, these can be utilized to perform L+R addition as indicated in amplifier 14C. A minimal CPS processor 12B is required only to perform the subtractive portion of the CPS processing; thus the cost of adding a CPS processor function to an existing system can be reduced.

FIG. 3A shows an alternative passive summing circuit that does not require dual amplifier inputs and thus enables the use of two similar single-input amplifiers 14B: a pair of equal resistors R3 and R4 connected as shown with the common terminal connected to the single input of amplifier 14B. A 6 dB insertion loss in the sum channel must be taken into account in setting the gains of amplifiers 14B for overall system S/D balance.

Figure 4:
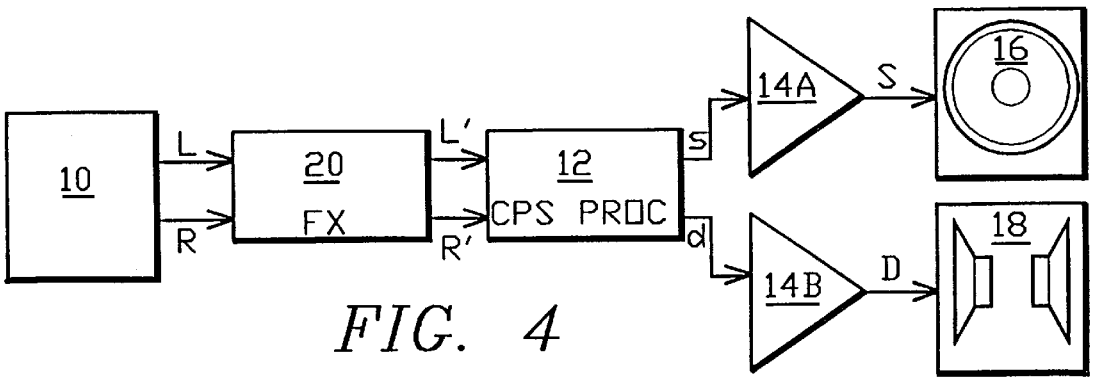

FIG. 4 is an upgrade modification that is applicable to the subject matter of FIGS. 1–3, with the addition of a stereo FX (effects) unit 20 interposed between source 10 and CPS processor 12. Such FX units are commercially available, providing special sound processing such as reverb, flanging, delay, echo and other musical effects. There is a trend to implement such FX units digitally using DSP (digital sound processing) to greatly expand their variety, capabilities and flexibility.

Figure 5:
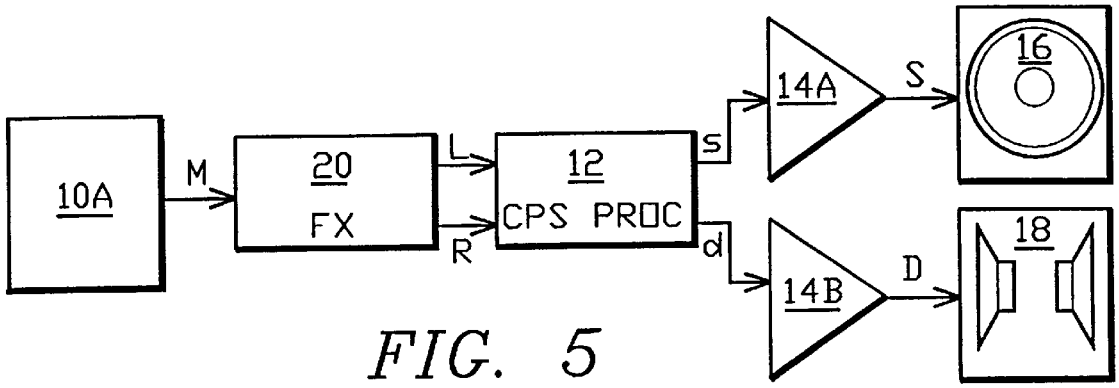

FIG. 5 is a mono-sourced version applicable to the subject matter of FIGS. 2–4 wherein a monaural musical source 10A provides only a monophonic signal M. Many FX units are designed to operate from either a mono or a stereo source, thus FX unit 20 accepts a monophonic signal M as input and converts it to a pair of (synthesized) stereo signals delivered as L and R outputs driving the CPS processor.

Figure 6:
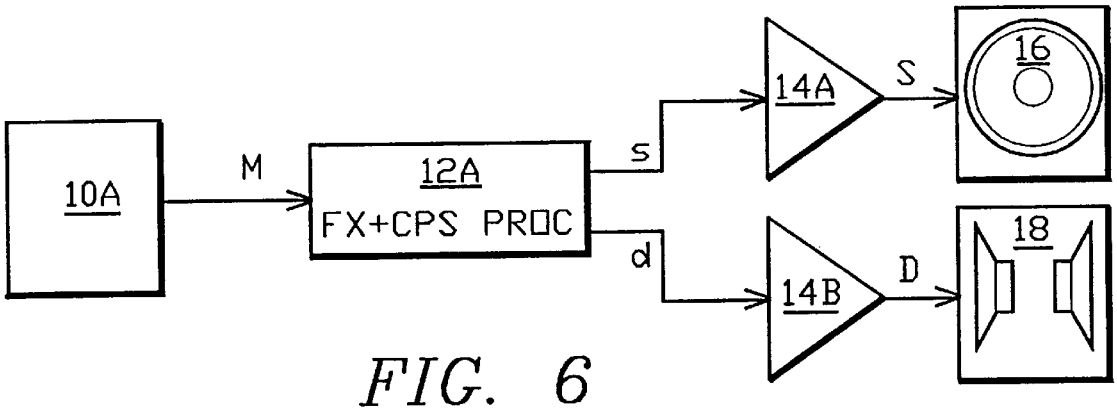

FIG. 6 is a version of the subject matter of FIG. 4 wherein the FX and CPS processing functions are combined in a custom FX+CPS processing unit 12A which accepts a mono source signal and delivers 5 and d signals for driving the power amplifiers 14B.

Figure 7:
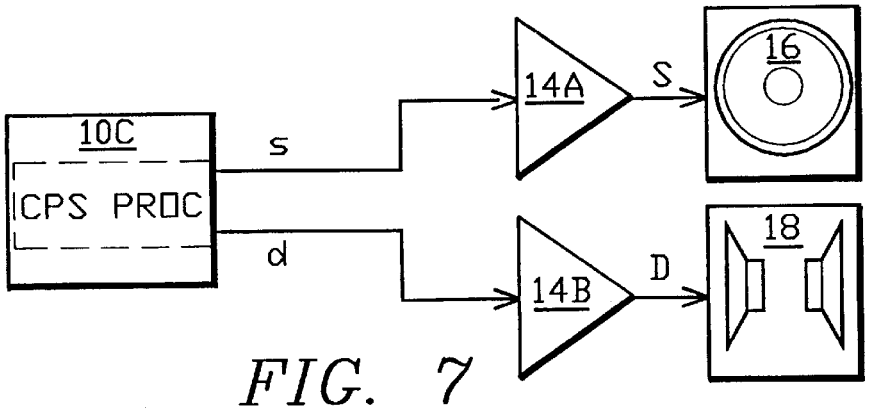

In FIG. 7, the source 10C incorporates a built-in CPS processor, equivalent to CPS processor 12 in FIGS. 1, 2, 4, and 5, contained within the body of a guitar or keyboard unit, so that CPS according to this invention can be practiced with only the addition of the special dipole loudspeaker unit 18 along with conventional components: amplifiers 14A, and forward-directed loudspeaker unit 16.

There are various different ways in which a CPS processor 12 of FIGS. 1, 2, 4, and 5, and the dipole loudspeaker unit 18, as the two special building blocks, taught by this invention, can be combined with conventional components, i.e. musical sound source 10, amplifiers 14A and 14B, and a forward-facing loudspeaker unit 18 to form functional systems for practicing this invention. The realization of two special components of the invention, CPS processor 12 and dipole loudspeaker unit 18, will now be described in greater detail in connection with FIGS. 8–12A FIG. 8 is a schematic diagram of CPS processor 12 of FIGS. 1, 2, 4 and 5. Four op-amps, 0A1–0A4, perform addition and subtraction of the L and R audio signals applied to the input at jacks J1 and J2, and thus provide the difference signal d at J3 and the sum signal S at J4 as line level outputs. These four op-amps 0A1–0A4 may be implemented by two dual IC's type 4560.

The sum signal 5 is also directed through a low pass filter LPF and level-adjustment potentiometer R23 to output jack J5 which thus provides a line output that is equalized for driving a sub-woofer amplifier/speaker system.

The sub-woofer line output is an optional deluxe feature that is not essential to basic practice of the invention.

Figure 8:
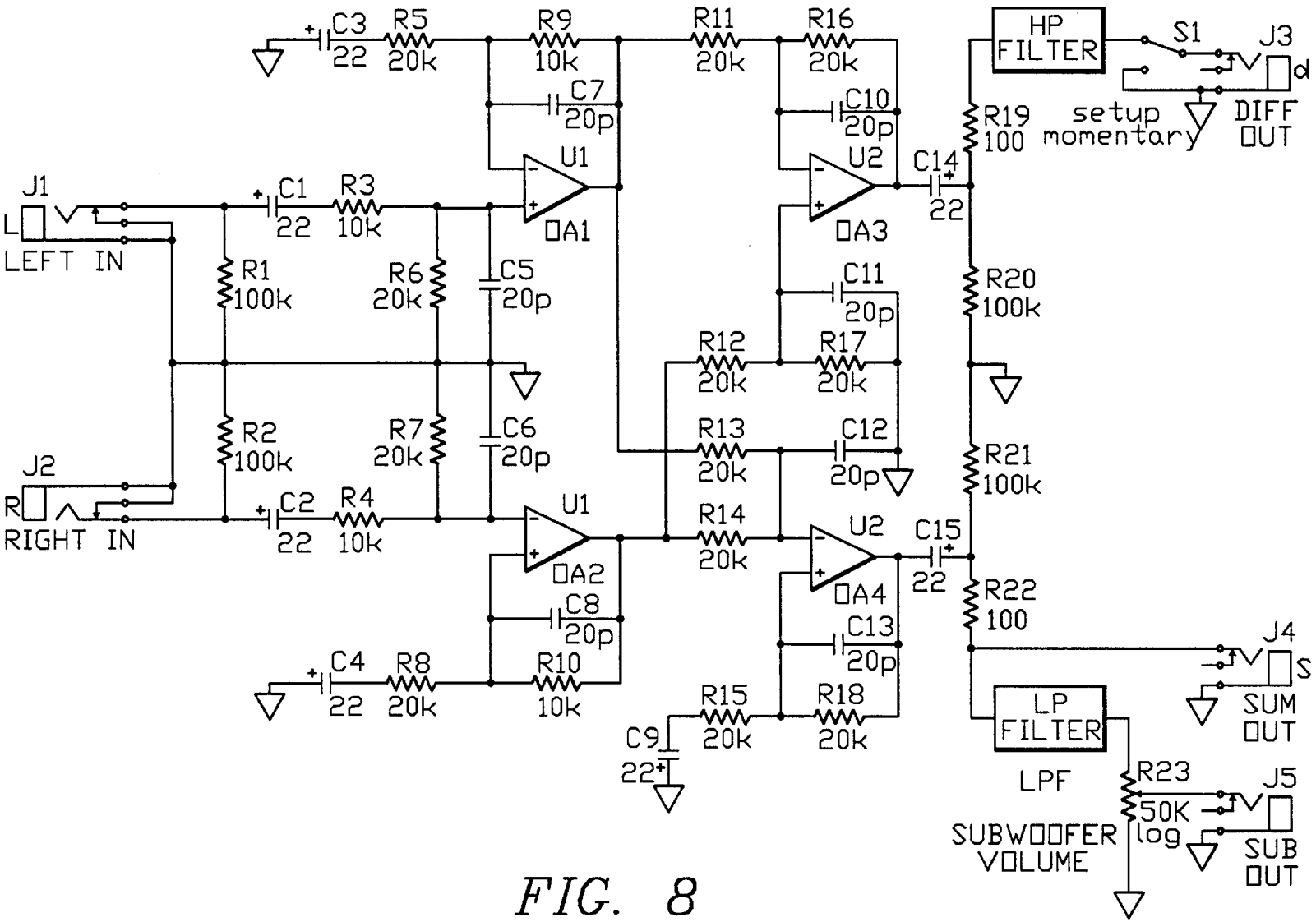
FIG. 8 is a schematic diagram of the CPS processor unit of FIGS. 1, 2, 4–7.
Figure 8A:
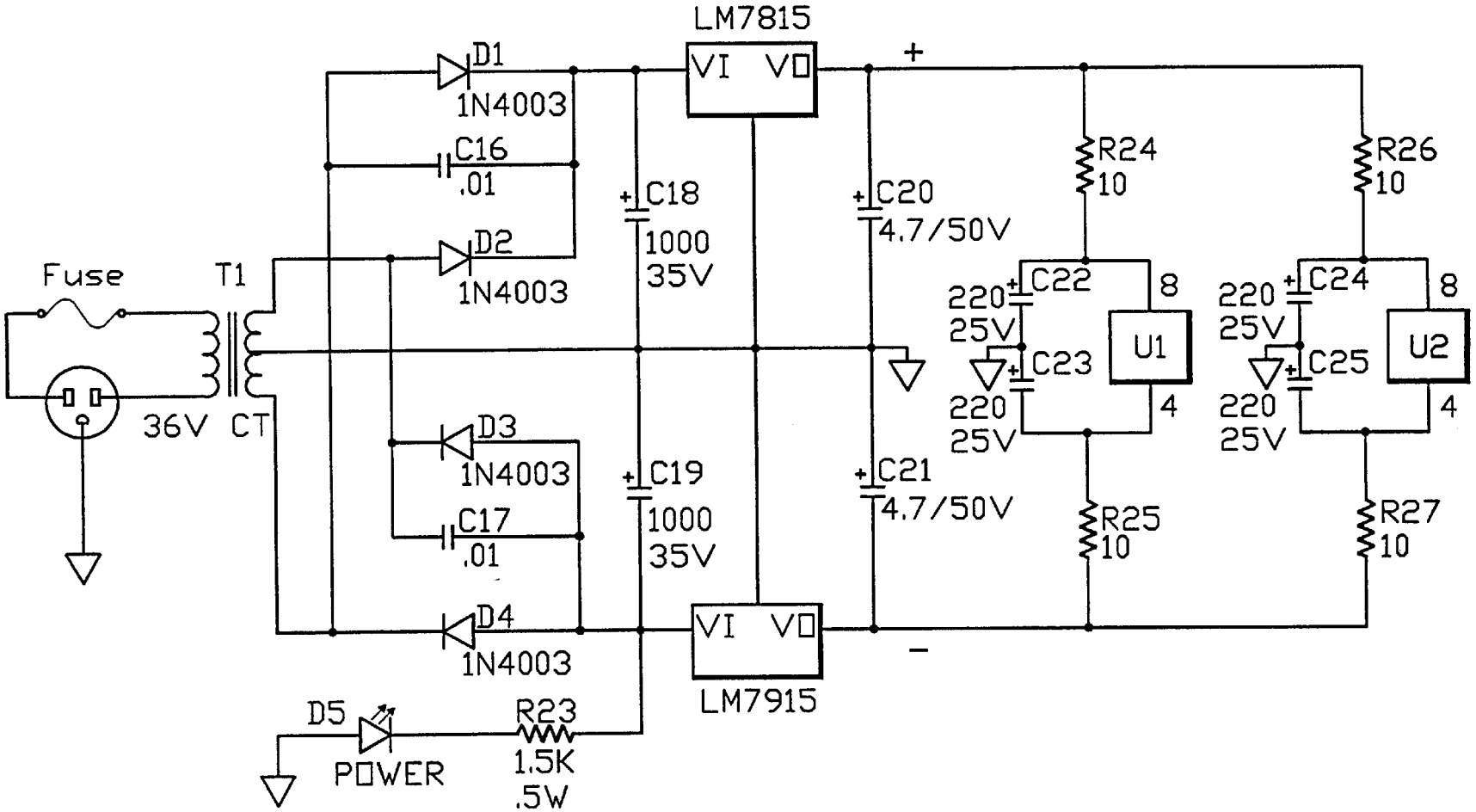
FIG. 8A is a schematic diagram of a power supply for the CPS processor of FIG. 8.

FIG. 8A is schematic of a dual regulated power supply for providing D.C. power to CPS processor 12 of FIG. 8.

FIG. 9 is a front elevational view of a dipole loudspeaker assembly 18 having a substantially open housing 24. Speaker 26 is mounted on a baffle board 24A which is located within housing 24 at or near the center thereof. The front panel of housing 24 is configured with a large opening, defined by edge 24B, that can be dimensioned to influence sound dispersion as a matter of design choice. Loudspeaker 26 is shown directed (arbitrarily) to the left thus its forward acoustic wave emanates to the left and its back wave emanates to the right; since these waves are opposite in polarity, the directivity pattern is inherently a "figure 8", typical of the dipole configuration, e.g. a dipole antenna. Due to open basket structure of speaker 26, the back wave directed to the right is practically equal in sound pressure to the front wave directed to the left, so that the "figure 8" dipole directivity pattern is practically symmetrical, especially in the mid-frequency range that plays the major role in stereo imaging and spatialization.

It is an advantage of the CPS system that high and/or low frequency reinforcement can be readily implemented by adding a tweeter and/or (sub) woofer to the forward-directed unit only, whereas in conventional RL stereo, these must be added to both channels or implemented via an additional central loudspeaker unit with special cross-over and matrixing.

FIG. 9A is the right hand end elevational view of the dipole loudspeaker assembly 18 of FIG. 9: the rear view of speaker 26, mounted on baffle board 24A is seen through a large opening defined by edge 24C configured in housing 24.

FIG. 9B is a plan view of the dipole loudspeaker assembly 18 as seen looking down from above: a topside opening defined by edge 24D reveals speaker 26 mounted on baffle 24A.

The outline of enclosure 24 can be dimensioned to conform to other available loudspeakers or equipment enclosures, e.g. for stacking purposes.

FIG. 10 shows a front elevational view of a dual-speaker dipole loudspeaker assembly 18A that is functionally similar to loudspeaker assembly 18 shown in FIGS. 9–9B: an open housing 28 is configured with a central baffle board 28A. However instead of a single speaker, there are two speakers 26A, seen through the opening defined by edge 28B, mounted face-to-face on a common opening in the central vertical baffle board 28A which defines a central axis of the housing 28. The two speakers 26A are connected (in series or parallel) in opposite polarity so that their diaphragms are caused to move in unison as indicated by the two arrows, thus they act together to provide the equivalent effect of a single diaphragm; however their complementary diaphragm movement serves to balance inherent voice coil travel non-linearities of each speaker 14B and thus provide superior linearity and fidelity compared to a single speaker.

FIG. 11 shows a front elevation of a dipole loudspeaker assembly 18B that is functionally similar to the assemblies 18 and 18A in FIGS. 9 and 10 in that housing 30 is open and is configured with a central baffle board 30A, however speakers 26B are surface-mounted on opposite sides of baffle board 30A, facing in opposite directions, and, as seen in the right hand end elevational view, FIG. 11A, and in the plan view, FIG. 11B, as viewed from above, the two speakers 26B are offset from each other in a side-by-side oppositely-facing disposition.

The category of central-baffle open-housing dipole loudspeaker assemblies as exemplified above in FIGS. 10–11B, can be implemented with any number of additional speakers mounted on the central baffle; typically an even total number of speakers is divided into two groups of oppositely-facing speakers arranged in a complementary pattern, all connected so as to vibrate in unison.

In this central-baffle category, the housing can be made to have open regions as indicated on any or all of its six panel areas; the size and location of the openings are allocated in design to control the sound dispersion.

FIG. 12 shows a front elevational view of a dual-speaker dipole loudspeaker assembly 18C that differs from the open-housing category described above in that the housing 18C is constructed in the manner of a conventional loudspeaker enclosure, having no central baffle or large openings or ports other than those associated directly with the two speakers 26C shown in dashed outline mounted back-to-back at opposite sides of enclosure 18C.

As in dipole loudspeaker units generally, speakers 26C are connected with polarity such to cause their diaphragms to vibrate in unison as indicated by the two arrows. This arrangement results in much different operating conditions than are found in conventional speaker enclosures: the unison vibration condition tends to cancel sound pressure buildup inside the enclosure 18C even if it is made practically air-tight.

As with the dual speaker central-baffle approach, each of the two side speakers 28C could be replaced by two or more speakers, typically with smaller ones.

Generally in the dipole loudspeaker implementations, including all of those described above, the speakers in a dipole loudspeaker unit can be made identical; they are generally not required to handle low bass frequencies since such lower frequencies contribute little to stereo effect, so the lower frequencies are typically handled elsewhere in the overall loudspeaker system, e.g. in a woofer or sub-woofer unit that could be made as part of the forward-directed unit.

The foregoing examples of dipole loudspeaker units, enclosure openings and speaker openings are shown without covering for clarity of illustration; however in actual practice these will generally be covered with grill cloth or screen of known art for appearance and protection.

Figure 13:
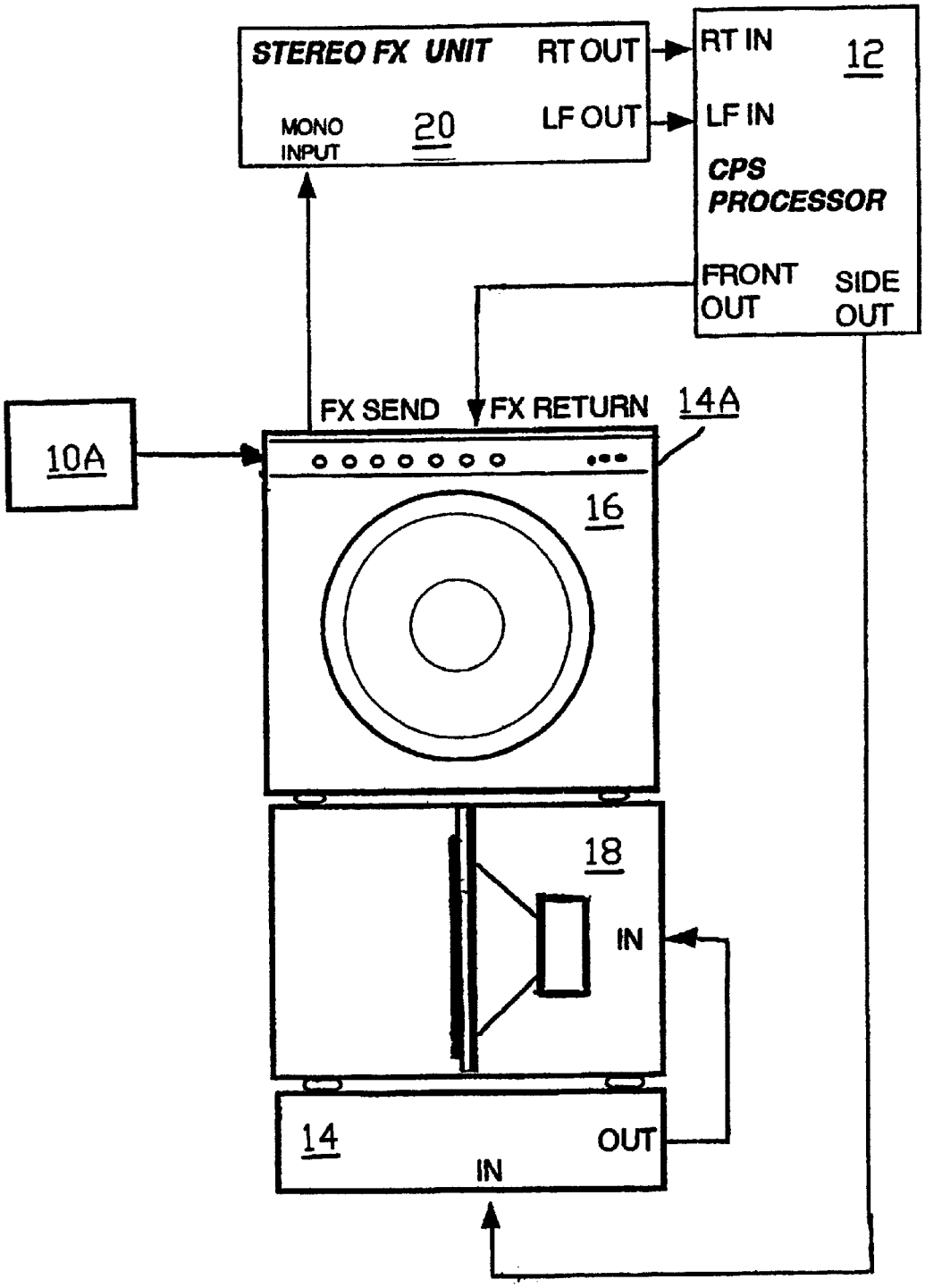
FIG. 13 is an elevational pictorial diagram of a CPS system related to FIG. 5, utilizing a forward-directed commercial mono guitar amplifier-speaker combination in the sum channel.

FIG. 13 depicts a two-unit loudspeaker stack having a dipole loudspeaker unit 18, shown as a single-speaker unit, similar to unit 18 in FIGS. 9–9B. The housing of dipole loudspeaker unit 18 is dimensioned to a modular size and supports a combo-amp unit having forward-directed loudspeaker unit 16, driven by a built-in amplifier unit 14A. Monophonic input from the musical instrument source 10 is applied as input to amplifier 14A and directed internally via a "FX send" line to FX unit 20 which provides L and R stereo line outputs, applied as input to the CPS processor 12.

Output d (difference L–R) from CPS processor 12 is applied to dipole loudspeaker unit 18 driven from power amplifier 14B shown located beneath dipole loudspeaker unit 18.

The s (sum L+R) output of CPS processor 20 is applied to amplifier 14A via an "FX return" line input.

This arrangement allows the player, with only a monophonic output from the instrument, to very conveniently switch back and forth, using a switch on amplifier 14A, between (a) a regular monophonic system utilizing only forward-directed speaker unit 16, and (b) a multi-function stereophonic system utilizing FX unit 20, CPS processor 12 and dipole loudspeaker unit 18.

Figure 14:
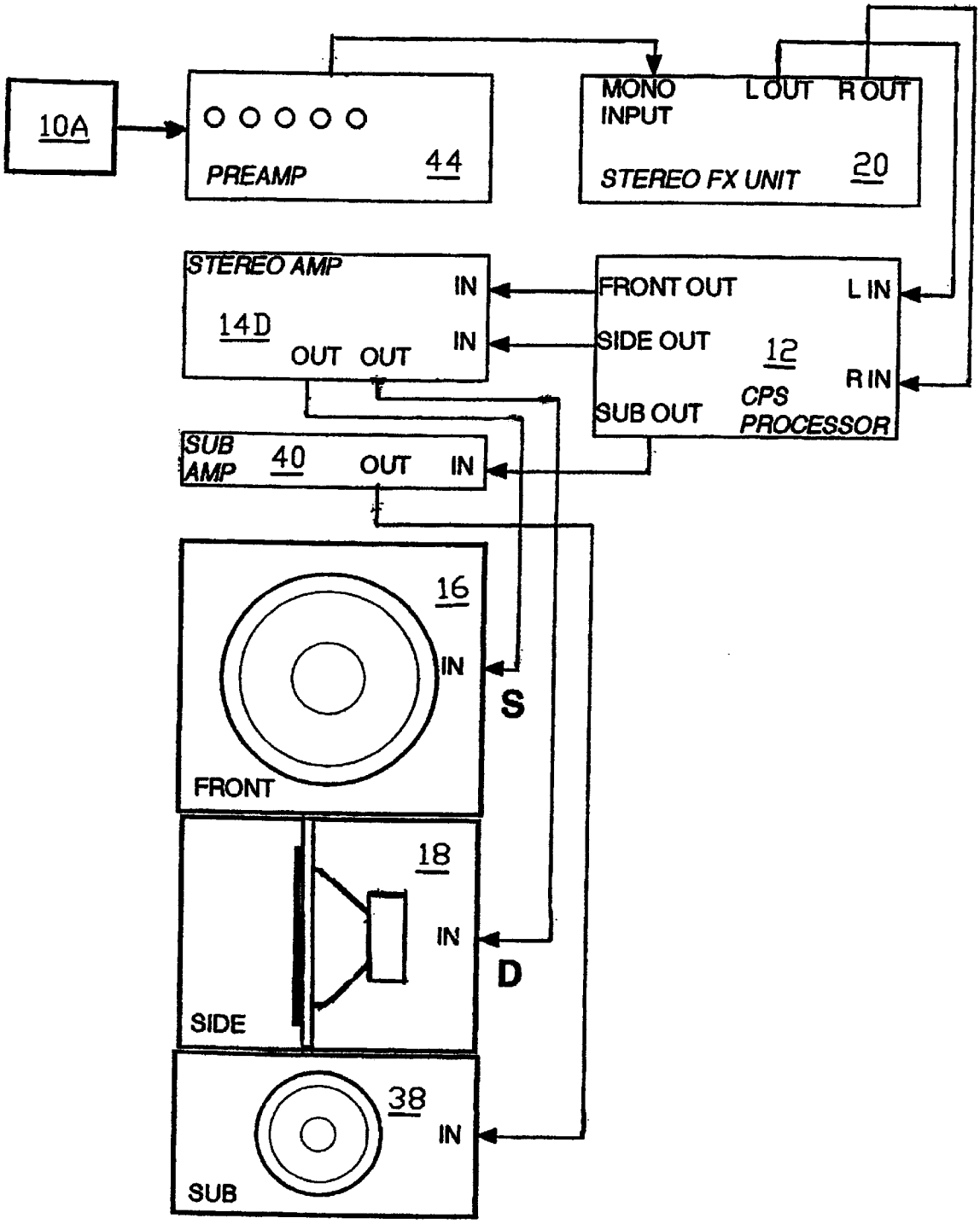
FIG. 14 is an elevational pictorial block diagram of a CPS system related to FIG. 5, showing an elevational view of a triple-unit loudspeaker stack having a modular sub-woofer loudspeaker unit added beneath the dipole loudspeaker unit and the forward-directed loudspeaker unit.

FIG. 14 depicts a three-speaker stack including a modular sub-woofer unit 38 beneath the dipole loudspeaker unit 18. Sub-woofer unit 38 is driven from power amplifier 40, which receives input from the sub-woofer line output of CPS processor 12.

An input preamp 44, receiving a monophonic source signal from a musical instrument source 10, applies the source signal to the monophonic line input of FX unit 20, whose stereo L and R line outputs are applied to the line inputs of CPS processor 16. The s and d line outputs of CPS processor 16 are applied to the two line inputs of a stereo amplifier 14D, which drives forward-directed loudspeaker unit 16 and dipole loudspeaker unit 18 so as to generate center point stereo sound.

Figure 15:
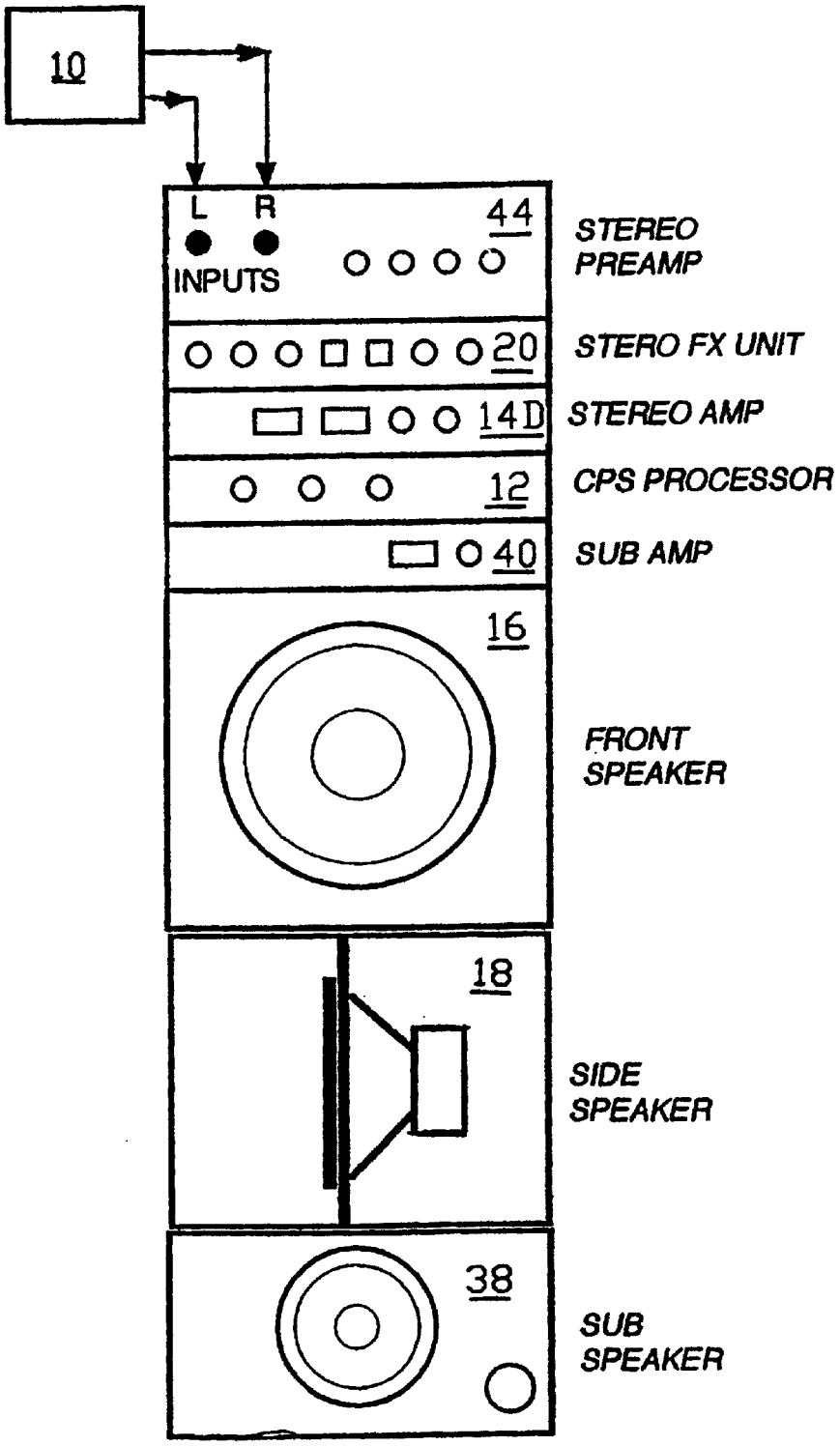
FIG. 15 is an elevational pictorial diagram of a rack-mounted CPS system operating from a stereo source as in FIG. 4 but otherwise containing essentially all of the components of FIG. 14 in a single stack.

FIG. 15 is a front elevation representation of a rack-mounted system that provides in a single tower unit all of the components of FIG. 13: starting from the bottom, sub-woofer unit 38, dipole loudspeaker unit 18, forward-directed loudspeaker unit 16, sub-woofer power amplifier 40, CPS processor 12, stereo power amplifier 14C, stereo FX unit 20 and input preamplifier 44. This single tower requires only a monophonic musical source such as a guitar or keyboard/tone generator to provide a full operating system for live performance that will fill an auditorium with stereo sound effects emanating entirely from the rack as the center point source of stereo sound.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A method for creating three dimensional embellished musical sound images originating from a live performance of a musical instrument wherein the sound images are formed by aural combination of sound emanating from two dissimilar loudspeaker units co-located in a listening environment at a center point of a CPS system, i.e. a center point stereo system, comprising the steps of:

a) performing music on the musical instrument so as to generate a real-time multi-component electrical source signal representing the performed music;

b) processing the source signal in a manner to generate therefrom (1) a sum signal representing a sum of two selected component portions of the source signal and (2) a difference signal representing difference between the two selected component portions of the source signal;

c) amplifying the sum signal in a first power amplifier so as to provide a power-amplified sum signal;

d) amplifying the difference signal in a second power amplifier so as to provide a power-amplified difference signal;

e) applying the power-amplified sum signal to a forward-directed loudspeaker unit, located at the center point, constructed, arranged and oriented to emanate a sum sound field in a unidirectional pattern predominantly in a forward direction toward an audience region of the listening environment;

f) applying the power-amplified difference signal to a sideways-directed dipole loudspeaker unit, co-located generally at the center point along with the forward-directed loudspeaker unit, said dipole loudspeaker unit being constructed, arranged and oriented to emanate a difference sound field in a dipole pattern having two oppositely-polarized lobes directed substantially in opposite side directions perpendicular to the forward direction;

whereby a sum sound field reaching a listener in the audience region via a predominantly direct path and a difference sound field reaching the listener via a predominantly reflected path are caused to combine aurally such that the listener is caused to perceive stereophonic images representing the performed music spread panoramically left and right of the common central loudspeaker location.

2. The method for creating a stereo musical sound image as defined in claim 1, comprising in step b) the sub-steps of:

b1) deriving from the source signal a left stereo signal and a right stereo signal;

b2) applying the left stereo signal and the right stereo signal to a summing circuit constructed and arranged to generate therefrom a sum signal representing a sum of the left and right stereo signals;

b3) applying the left stereo signal and the right stereo signal to a subtracting circuit constructed and arranged to generate therefrom a difference signal representing a difference between the left and right stereo signals.

3. The method for creating a stereo musical sound image as defined in claim 1, comprising the further the sub-steps of:

b1) deriving from the source signal a left stereo signal and a right stereo signal;

b2) applying the left and right stereo signals to inputs of a stereo musical effects unit constructed and arranged to modify the left and right stereo signals in a predetermined manner and to provide as output left and right modified stereo signals;

b3) applying the left and the right modified stereo signals to a summing circuit constructed and arranged to generate therefrom a sum signal representing a sum of the left and right modified stereo signals;

b4) applying the left and the right modified stereo signals to inputs of a subtracting circuit constructed and arranged to generate therefrom a difference signal representing a difference between the left and right modified stereo signals.

4. The method for creating a stereo musical sound image as defined in claim 1, comprising the further steps of:

f) processing the sun signal from step b) through a frequency response modifying circuit that attenuates high frequency components of the sum signal to provide a sub-woofer signal; and g) applying the sub-woofer signal to a sub-woofer loudspeaker unit via a third amplifier so as to add bass reinforcement to the first sound pattern.

5. A stereo center-point music performance system for providing a stereo musical sound image from two dissimilar loudspeaker units co-located at a common center point, comprising:

a musical instrument constructed and arranged to generate a real time electrical source signal representing a music performed thereupon;

an audio processing system, receiving as input the source signal from said musical instrument, constructed and arranged to derive and generate therefrom (1) a line level sum signal representing a sum of two selected component portions of the source signal and (2) a line level difference signal representing difference between the two selected component portions of the source signal, the two component portions being selected in a manner to enable creation of a desired stereo image from acoustic recombination of the two component portions;

a first audio power amplifier receiving as input the line level sum signal and providing as output a power-amplified sum signal;

a second audio power amplifier receiving as input the line level difference signal and providing as output a power-amplified difference signal;

a forward-directed loudspeaker unit, having at least one vertically-mounted speaker driven by the power-amplified sum signal, arranged and oriented to emit sound in a generally forward direction; and a sideways-directed dipole loudspeaker unit, having at least one vertically-mounted speaker driven by the power-amplified difference signal, said sideways-directed dipole loudspeaker unit being co-located with said forward-directed loudspeaker unit and oriented generally perpendicular thereto, and being constructed and arranged to emit sound in a dipole pattern, i.e. of opposite phase polarity and in opposite sideways directions, generally perpendicular to the forward direction.

6. The stereo center-point music performance system as defined in claim 5 wherein said audio processing system comprises;

an electronic audio processing module, receiving as input the source signal from said musical instrument, constructed and arranged to generate, as outputs, the line level sum signal and the line level difference signal.

7. The stereo center-point music performance system as defined in claim 5 wherein said audio processing system comprises;

a stereo matrixing circuit, receiving as input the source signal, constructed and arranged to generate therefrom a left stereo signal and a right stereo signal; and a CPS processor, receiving as input the left and right stereo signals, constructed and arranged to generate as output the line level sum signal and the line level difference signal.

8. The stereo center-point music performance system as defined in claim 5 wherein said audio processing system comprises;

a stereo matrixing circuit, receiving as input the source signal, constructed and arranged to generate therefrom a left stereo signal and a right stereo signal;

a stereo musical effects unit, receiving as input the left and right stereo signals, constructed and arranged to modify at least one the left and right stereo signals in a predetermined manner and to generate therefrom a left modified signal and a right modified stereo signal; and a CPS processor, receiving as input the left and right modified stereo signals, constructed and arranged to generate as output the line level sum signal and the line level difference signal.

9. The stereo center-point music performance system as defined in claim 5 wherein said sideways-directed dipole loudspeaker unit comprises;

a rectangular baffle board oriented vertically and in a fore-and-aft direction, provided with a generally circular speaker cutout region;

a cone-type speaker mounted centrally on a first side of said baffle board, concentric with the cutout region; and a substantially open housing configured as a framework housing totally surrounding said speaker and baffle board, attached to said baffle board.

10. The stereo center-point music performance system as defined in claim 5 wherein said sideways-directed dipole loudspeaker unit comprises;

a rectangular baffle board oriented vertically and in a fore-and-aft direction, provided with a generally circular speaker cutout region;

a first speaker, having a cone diaphragm, mounted on a first side of said baffle board concentric with the cutout region;

a second speaker, having a cone diaphragm, mounted on a second side of said baffle board, opposite the first side, concentric with the cutout region, connected electrically to said first speaker in a manner to cause both cone diaphragms to vibrate in unison under a driven condition; and a generally open housing configured as a framework totally surrounding said speakers and baffle board, attached to said baffle board.

11. The stereo center-point music performance system as defined in claim 5 wherein said sideways-directed dipole loudspeaker unit comprises;

a rectangular baffle board oriented vertically and in a fore-and-aft direction, provided with first and second generally circular speaker cutout regions located in mutually offset relation side by side;

a first speaker, having a cone diaphragm, mounted on a first side of said baffle board concentric with the first cutout region;

a second speaker, having a cone diaphragm, mounted on a second side of said baffle board, opposite the first side, concentric with the second cutout region and thus in face-to-face relation with said first speaker, connected electrically to said first speaker in a manner to cause both cone diaphragms to vibrate in unison under a driven condition; and a generally open housing configured as a framework totally surrounding said speakers and baffle board, attached to said baffle board.

12. The stereo center-point music performance system as defined in claim 5 wherein said sideways-directed dipole loudspeaker unit comprises:

a rectangular baffle board oriented vertically and in a fore-and-aft direction, provided with first and second generally circular speaker cutout regions located in mutually offset relation side by side;

a first speaker, having a cone diaphragm, mounted on a first side of said baffle board concentric with the first cutout region;

a second speaker, having a cone diaphragm, mounted on a second side of said baffle board, opposite the first side, concentric with the second cutout region and thus in face-to-face relation with said first speaker, connected electrically to said first speaker in a manner to cause both cone diaphragms to vibrate in unison under a driven condition; and a generally open housing configured as a framework totally surrounding said speakers and baffle board, attached to said baffle board.

13. The stereo center-point music performance system as defined in claim 5 wherein said sideways-directed dipole loudspeaker unit comprises;

a generally closed housing having two opposite parallel panels each configured with a speaker cutout opening; and first and second speakers, each having a cone diaphragm, and each mounted on a respective one of the parallel panels in an acoustical operational relationship with the cutout opening thereof, said speakers being interconnected electrically in a manner to cause both cone diaphragms to vibrate in unison under a driven condition.

* * * * *